United States Patent [19]

Tung

[11] Patent Number: 4,654,766

[45] Date of Patent: Mar. 31, 1987

[54] STRUCTURE FOR A STRING OF BULBS

[76] Inventor: Kung-Chao Tung, No. 24, Chi East Street, Taipei City, Taiwan

[21] Appl. No.: 747,267

[22] Filed: Jun. 21, 1985

[51] Int. Cl.[4] ..... F21V 21/00

[52] U.S. Cl. ..... 362/249; 362/227; 362/448

[58] Field of Search ..... 362/249, 227, 382, 251, 362/252, 407, 448, 449, 800, 806

[56] References Cited

U.S. PATENT DOCUMENTS

| | | | |
|---|---|---|---|
| 3,551,723 | 12/1970 | Groningen | 362/227 X |
| 3,745,330 | 7/1973 | Frost | 362/227 |
| 3,894,225 | 7/1975 | Chao | 362/249 |
| 4,107,767 | 8/1978 | Anguetin | 362/249 X |
| 4,376,966 | 3/1983 | Treszen | 362/249 |
| 4,514,791 | 4/1985 | Tokieda | 362/448 X |

*Primary Examiner*—Larry Jones

*Attorney, Agent, or Firm*—Asian Pacific International Patent & Trademark Office

[57] ABSTRACT

The bulb seat structure serves to replace the conventional bulb seat in a string of bulbs. In assembling operation, the two conductive rods of the bulb are inserted into the grooves of the bulb seat, and two wires are twisted into a spiral wire to connect all bulbs in parallel to form a string of bulbs.

6 Claims, 3 Drawing Figures

STRUCTURE FOR A STRING OF BULBS

BACKGROUND OF THE INVENTION

In the prior art string of bulbs (for decoration purpose), the structure thereof can not but use the series connection method between the bulb seats (or bulbs). Consequently, the reliability of the string of bulbs is rather low; for example, one bulb being out of order will jeopardize the power supply of the whole string of bulbs. Recently, a shunt bulb has been developed, but the length of the string is still limited. Further, the conventional string of bulbs presents a salient or conspicuous appearance, which would adversely affect the decorative effect. The small bulb seat for the conventional string of bulbs is difficult to manufacture (requiring higher precision), and it is rather difficult to develop the smallest string of bulbs to be used as a decoration for smaller items. Such small bulb strings also require longer manufacturing time thereby increasing the basic cost, which renders it of less industrial value. Therefore, the target of industry in that field has been set in the areas of how to make every effort to shorten the manufacturing time, to lower the basic cost, and to increase reliability of the string of bulbs.

SUMMARY OF THE INVENTION

This invention relates to a new structure for a string of bulbs, of which the prime feature is the specially designed bulb seat, which, during assembling, needs no close and tight contact with the bulb, but requires merely bending of the two conductive rods of the bulb into the two grooves on the both sides of the bulb seat respectively. This technique will prevent any poor contact between the bulb and the bulb seat.

Another feature of the present invention is that the conducting wires which serve to connect the bulb seats are twisted in spiral fashion so as to save a lot of time during assembling. Moreover, since the bulbs are connected in parallel, the string of bulbs would have better reliability, show considerable convenience in cutting a desired length of the string of bulbs, and in replacing the bulb seat or the bulb. All the aforesaid features and conveniences are not shown in the conventional string of bulbs, and consequently, my improvement can be regarded as a breakthrough in such ornamental or decorative bulb or light strings.

DETAILED DESCRIPTION

This invention has been developed through careful studies of the structure of a string of bulbs and the illumination effect thereof, and a series of experiments and comparisons. In addition to the features of novelty, requiring less manufacturing time, lowering the manufacturing cost, and increasing the reliability, the present invention can provide a smaller string of bulbs. The prime feature of the present invention is the uniquely designed bulb seat structure to replace the conventional bulb seat structure. The new bulb seat needs no close connection between bulbs upon mounting the bulbs in the string; instead, the two conductive rods of a bulb are bent and inserted into the grooves on the both sides of the bulb seat. This design can substantially preclude and prevent troubles caused by improper connection between the bulb and the bulb seat.

Another feature of the present invention is that the wire to connect the bulb seats is a spiral wire, which is twisted into form at the last assembling stage of the string of bulbs. That spiral wire not only can fix the position of the bulbs, and can provide the bulbs with a power supply, but also can facilitate the decoration purpose because of its flexibility.

A still further feature of the present invention is that the bulbs and the wire (conducting wire) are connected in parallel to provide an enhanced operation, and to facilitate the string of bulbs being cut at any length required; further, this feature provides a breakthrough in comparison with the conventional string of bulbs in terms of use.

Figure 1:
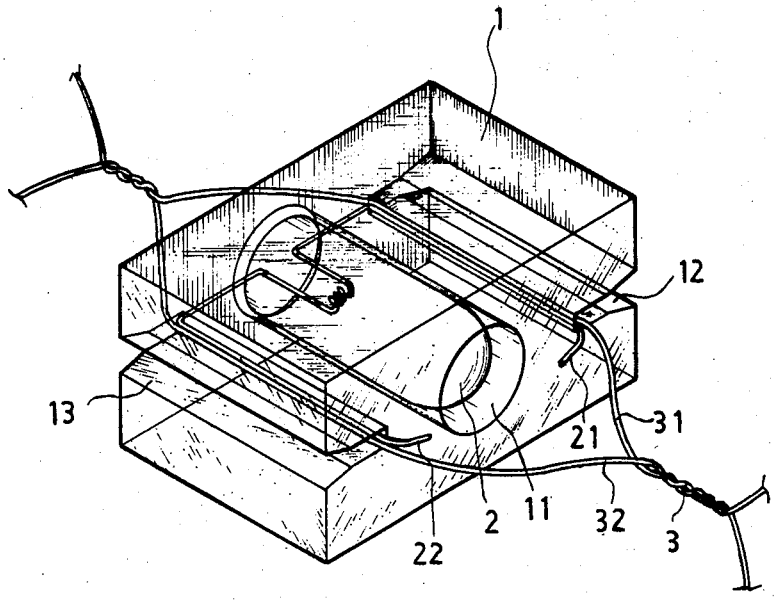
FIG. 1 is a perspective view of an embodiment of the bulb seat according to the present invention.

The present invention is further described in detail, with reference to the drawings attached, as follows:

Referring to FIG. 1, there is shown a perspective view of an embodiment of a bulb seat 1 structure, which may be made of a transparent material or materials in various colors. In the bulb seat 1, there is furnished a through hole 11 to receive the bulb 2. Two grooves 12 and 13 are provided on the sides of the bulb seat 1 respectively for mounting the two conductive rods 21 and 22 of the bulb 2 and two conducting wires 31 and 32 of the spiral wire 3 respectively. The grooves 12 and 13 are generally positioned in the same plane with reference to the bulb seat 1.

In the assembling operation, insert the bulb 2 into the through hole 11, and bend the two conductive rods 21 and 22 into the grooves 12 and 13 respectively, and cut the portions of the rods 21 and 22 that extend out of the grooves; then, put the portions of the conducting wires 31 and 32, of which the insulating coating is removed, into the grooves 12 and 13 respectively, and twist the conducting wires. If necessary, the conductive rods 21 and 22 and the conducting wires 31 and 32 may be soldered or adhered together respectively for fixing the corresponding positions of the rods 21 and 22 and the wires 31 and 32.

Figure 2:
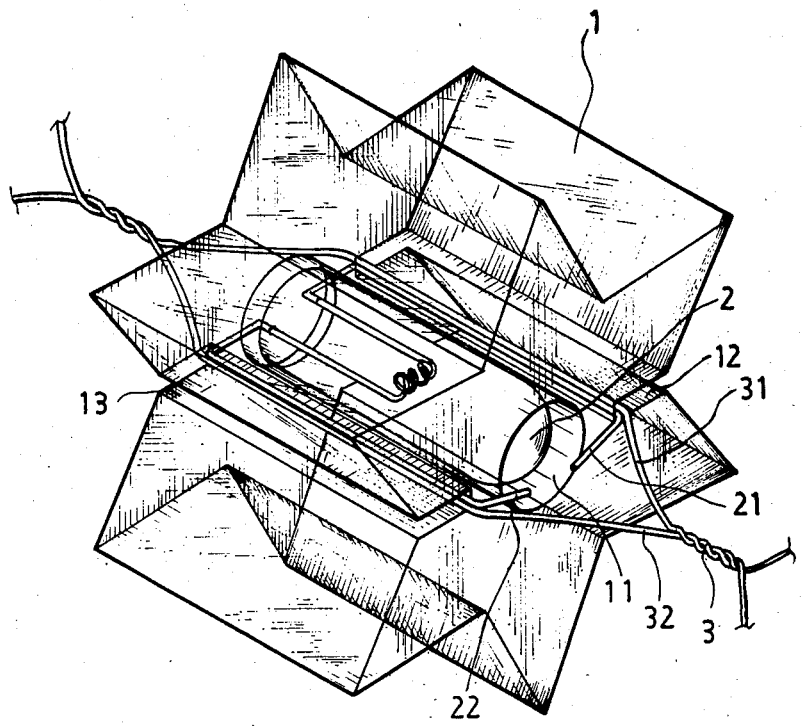
FIG. 2 is a perspective view of another embodiment of the bulb seat according to the present invention.

FIG. 2 illustrates another embodiment of the present invention, in which the outer shape of the bulb seat 1 would not affect the function of the bulb, i.e., the outer shape may be designed into any decorative form. The through hole 11 and the grooves 12 and 13 have a two-way assembling convenience; therefore, the present invention can provide considerable convenience in terms of manufacturing and assembling operations.

Figure 3:
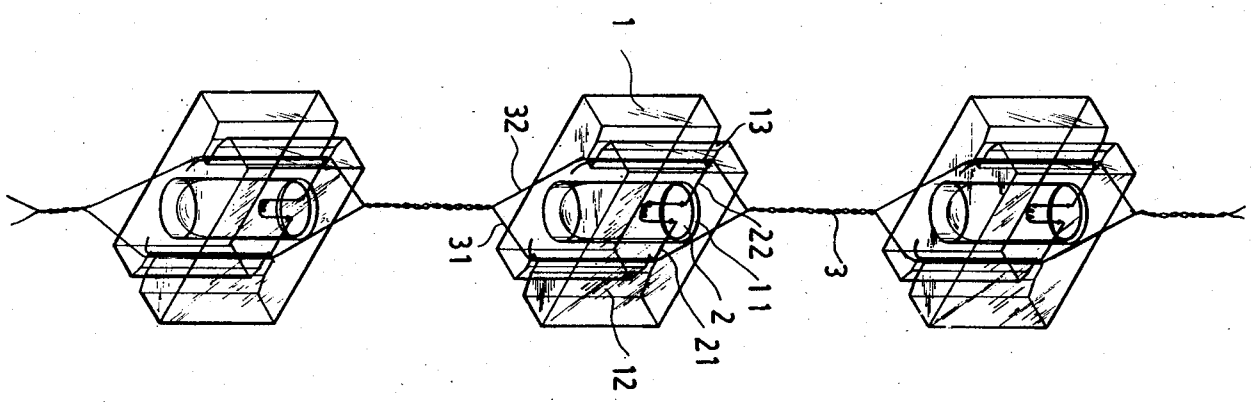
FIG. 3 is a perspective view of a string of lights according to the present invention.

FIG. 3 illustrates a string of bulbs being assembled according to the present invention, in which a portion of the insulating layer is removed first at a regular distance along the conducting wire, and is inserted into the grooves at both sides of the bulb seat; then, twist the two wires together to form a string of bulbs. If the wire is a bare wire, an insulating paper has to be sandwiched between the two wires before twisting them together. The bulb may be replaced with an LED in the present invention. In using an LED in the string, the LED may be controlled with a switch for lighting up or non-lighting operation by means of the one-way conduction characteristics of the LED.

In fact, the size of the bulb seat 1 may be reduced in accordance with the size of the bulb 2; for example, the longest size of the bulb seat 1 may not exceed 5 mm. With a battery of 1.5 V, a string of bulbs may be mounted over a small flower pot or on one's wrist so as to overcome the difficulty of the conventional string of bulbs, which can not be made into a very small string of bulbs because of the difficulties of manufacturing the negative electrode and the positive electrode parts, and of assembling them. Since the bulbs 2 are connected with the spiral wire in parallel, the spiral wire may be un-twisted for separation and to replace the bulb seat 1 and the bulb 2 if necessary, and there is little worry for any trouble on the electrodes. When designing the present invention, consideration has been given to the serviceable rate during manufacturing, the cost, the production speed, and the reliability thereof; in other words, all the drawbacks in the conventional string of bulbs have been improved; therefore, it is deemed novel.

I claim:

1. The string of lights comprising:

a plurality of bulb seats, each bulb seat including a multisided body having a walled passage extending into the body with a distance of length sufficient to accommodate a respective bulb, and each body having grooves for accommodation of respective conductors and conducting wires;

a plurality of bulbs for emitting light, each bulb including two conductive rods and each conductive rod having a length of distance corresponding approximately to that of the exterior groove in said body, and each conductive rod being adapted to be seated in its respective groove in said body; and a pair of conducting wires, with each wire being insulated but in the respective groove it is sufficiently uncovered to contact the associated conductive rod of a bulb, and said pair of wires being twisted between two bulb seats.

2. The string of lights as defined in claim 1 wherein each bulb seat is a of the same decorative shape.

3. The string of lights as defined in claim 1 with alternating decorative shapes of bulb seats.

4. The string of lights as defined in claim 1 wherein said conducting wires are insulated with a sheet of insulating material.

5. The string of lights as defined in claim 1 wherein said multisided body has exterior grooves for accommodation of respective conductors and wires.

6. The string of lights as defined in claim 1 wherein said multisided body has a central aperture for a respective bulb.

* * * * *